US009447560B2

(12) United States Patent
Kim et al.

(10) Patent No.: US 9,447,560 B2
(45) Date of Patent: Sep. 20, 2016

(54) PARALLEL LINKAGE-TYPE WORKING APPARATUS FOR CONSTRUCTION EQUIPMENT

(71) Applicants: DOOSAN INFRACORE CO., LTD., Incheon (KR); SNU R&DB FOUNDATION, Seoul (KR)

(72) Inventors: Hyuk Joong Kim, Incheon (KR); Young Sun Yoo, Gyeonggi-do (KR); Kyung Ho Hwang, Incheon (KR); Jong Won Kim, Seoul (KR); Yong Hee Han, Chungcheongbuk-do (KR); Sun Ho Kim, Gyeonggi-do (KR); Heung Keun Park, Gyeonggi-do (KR)

(73) Assignees: Doosan Infacore Co., Ltd., Incheon (KR); SNU R&DB Foundation, Seoul (KR)

( * ) Notice: Subject to any disclaimer, the term of this patent is extended or adjusted under 35 U.S.C. 154(b) by 104 days.

(21) Appl. No.: 14/369,062

(22) PCT Filed: Dec. 24, 2012

(86) PCT No.: PCT/KR2012/011385

§ 371 (c)(1),
(2) Date: Jun. 26, 2014

(87) PCT Pub. No.: WO2013/100521

PCT Pub. Date: Jul. 4, 2013

(65) Prior Publication Data

US 2014/0341690 A1 Nov. 20, 2014

(30) Foreign Application Priority Data

Dec. 27, 2011 (KR) ..... 10-2011-0143636

(51) Int. Cl.

| | |
|---|---|
| ***E02F 3/43*** | (2006.01) |
| ***E02F 3/34*** | (2006.01) |
| ***B66F 9/065*** | (2006.01) |
| ***E02F 9/22*** | (2006.01) |

(52) U.S. Cl.

CPC ..... *E02F 3/3408* (2013.01); *B66F 9/065* (2013.01); *E02F 3/433* (2013.01); *E02F 9/2271* (2013.01)

(58) Field of Classification Search

CPC ..... E02F 3/433; E02F 9/2271; E02F 3/43; B66F 9/065

USPC ..... 414/722

See application file for complete search history.

(56) References Cited

U.S. PATENT DOCUMENTS 2,645,369 A * 7/1953 Allan ..... E02F 3/3405 414/713

4,798,512 A 1/1989 Intveld (Continued)

FOREIGN PATENT DOCUMENTS

CN 1826448 A 8/2006
DE 19702624 A1 7/1998

(Continued)

OTHER PUBLICATIONS

Japanese Office Action dated May 26, 2015 for Japanese Application No. 2014-549983, 3 pages.

(Continued)

*Primary Examiner* — Gerald McClain
*Assistant Examiner* — Ronald Jarrett
(74) *Attorney, Agent, or Firm* — John D. Veldhuis-Kroeze; Westman, Champlin & Koehler, P.A.

(57) ABSTRACT

The present disclosure relates to a parallel linkage-type working apparatus for construction equipment in which a parallel lever and a parallel link operate to prevent a working tool from bending inward so that, even if the working tool is raised, a tilting phenomenon in which the working tool is inclined inward may be prevented, and an amount of change in posture of the working tool at each height may be reduced. Also, the parallel linkage-type working apparatus is capable of increasing excavation ability or power with a posture on the ground surface by supplying a larger amount of hydraulic fluid at one time when working hydraulic pressure is supplied to each cylinder head, in comparison with a case in which working hydraulic pressure is supplied to a cylinder rod.

3 Claims, 6 Drawing Sheets

(56) References Cited

U.S. PATENT DOCUMENTS

| | | | | |
|---|---|---|---|---|
| 6,116,847 | A * | 9/2000 | Ginn | E02F 3/283 414/700 |
| 8,226,344 | B2 * | 7/2012 | Osanai | B66F 9/065 414/685 |
| 2009/0053028 | A1 | 2/2009 | Osanai | |

FOREIGN PATENT DOCUMENTS

| | | | |
|---|---|---|---|
| JP | 02-085423 | | 3/1990 |
| JP | H09-165772 | | 6/1997 |
| JP | 2001-020310 | | 1/2001 |
| JP | 2002-004321 | | 1/2002 |
| JP | 2004-036153 | | 2/2004 |
| JP | 2007186929 | A | 7/2007 |
| KR | 10-2010-0057257 | | 5/2010 |
| KR | 10-998097 | | 12/2010 |
| WO | 90/06403 | A1 | 6/1990 |

OTHER PUBLICATIONS

Chinese Office Action dated Jun. 30, 2015 for Chinese Application No. 201280064936.X, 7 pages.

Search Report dated Apr. 16, 2013 and written in Korean with English translation for International Patent Application No. PCT/KR2012/011385 filed Dec. 24, 2012, 5 pages.

European Search Report dated Nov. 30, 2015 for European Application No. 12863324.5, 7 pages.

* cited by examiner

PARALLEL LINKAGE-TYPE WORKING APPARATUS FOR CONSTRUCTION EQUIPMENT

CROSS-REFERENCE TO RELATED APPLICATION

This Application is a Section 371 National Stage Application of International Application No. PCT/KR2012/011385, filed Dec. 24, 2012 and published, not in English, as WO 2013/100521 on Jul. 4, 2013.

FIELD OF THE DISCLOSURE

The present disclosure relates to a parallel linkage-type working apparatus for construction equipment, and more particularly, to a parallel linkage-type working apparatus for construction equipment, capable of preventing a tilting phenomenon in which a working tool (for example, a bucket) is inclined inward even if the working tool is raised by a lift arm, and increasing force (for example, excavating ability) at a posture on the ground surface while reducing an amount of change in posture at each height of the working tool.

In addition, the present disclosure relates to a parallel linkage-type working apparatus for construction equipment in which a main angle specification for operating a linkage is similar to a typical work environment, which has been used from the past, such that it is possible to enable even a worker who is a beginner to quickly become accustomed to using the apparatus without any separate training or perceiving a sense of difference.

BACKGROUND OF THE DISCLOSURE

Particularly, a small scale shovel series excavator or a wheel loader among various types of construction equipment has a working apparatus at a front side thereof, and the working apparatus includes a linkage which is operated by a hydraulic device, and a working tool such as a bucket which is connected to the linkage.

Therefore, the equipment may perform work for excavating and scooping objects such as soil, fertilizer, and snow by using the working tool with a posture on the ground surface, and may perform various types of work functions such as dumping work when the working tool is raised by a lift arm.

Meanwhile, the aforementioned equipment is known through various documents including Korean Patent No. 998097 and Korean Patent Application Laid-Open No. 2010-57257, and particularly equipment called 'Z BAR' as illustrated in FIG. 1 and equipment called 'Parallel or Tool Carrier (TC)' as illustrated in FIG. 2 are currently used widely in a construction site.

However, in the equipment called the 'Z BAR', since a tilting (or also called 'crowd') phenomenon occurs in which horizontality of the bucket cannot be maintained with respect to the ground surface, but the bucket is inclined inward when the bucket (working tool) connected to a linkage is raised as illustrated in FIG. 1, an amount of change in posture at each height of the bucket is large, and as a result, it is difficult for a worker to operate the equipment.

In contrast, in the equipment called the 'Parallel or Tool Carrier (TC)', since horizontality of a fork is continuously maintained with respect to the ground surface when the fork (working tool) connected to a linkage is raised as illustrated in FIG. 2, there is little change in posture at each height of the fork, or an amount of change in posture at each height of the fork is very small, but there is a problem in that force, which can be applied by the fork, is small.

That is, due to a structural problem of the linkage that operates the working tool such as the bucket or the fork in the related art, there is a problem in that an amount of change in posture at each height is large when the working tool is raised, or excavating ability of the bucket or force of the fork is small when there is no change in posture at each height.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

The present disclosure has been made in an effort to resolve the aforementioned problem, and an aspect of object of the present disclosure is to provide a parallel linkage-type working apparatus for construction equipment, capable of preventing a tilting phenomenon in which a working tool is inclined inward even if the working tool is raised by a lift arm, and increasing force at a posture on the ground surface while reducing an amount of change in posture at each height of the working tool.

In addition, another an aspect of object of the present disclosure is to provide a parallel linkage-type working apparatus for construction equipment in which a main angle specification for operating a linkage is similar to a typical work environment, which has been used from the past, such that it is possible to enable even a worker who is a beginner to quickly become accustomed to using the apparatus without any separate training or perceiving a sense of difference.

To this end, a parallel linkage-type working apparatus for construction equipment according to the present disclosure includes: a base frame which is connected to a front side of a traveling apparatus; side brackets which are provided at both upper sides of the base frame, respectively; a lift arm which has one end rotatably connected to an upper portion of the side bracket, and the other end rotatably connected to a bucket; a lift cylinder which has one end rotatably connected to a lower portion of the side bracket, and the other end rotatably connected to a central side in a length direction of the lift arm; a center bracket which is provided at an upper central side of the base frame; a parallel link which has one end rotatably connected to the center bracket; a parallel lever which has a lower portion rotatably connected to the other end of the parallel link; a bucket cylinder which has one end rotatably connected to an upper portion of the parallel lever; a tilt lever which has an upper portion rotatably connected to the other end of the bucket cylinder, and a lower portion rotatably connected to the bucket through a push link; and connecting shaft portions which have one end portions rotatably connected to a central side of the parallel lever, and the other end portions rotatably connected to a central side of the tilt lever.

In this case, the connecting shaft portion may include a fixed shaft which has both ends fixed to a pair of lift arms, respectively; a first connecting shaft which has one end rotatably connected to the fixed shaft, and the other end rotatably connected to a central side of the parallel lever; and second connecting shafts which are provided at both sides of the first connecting shaft, and have one ends rotatably connected to the fixed shaft, and the other ends rotatably connected to a central side of the tilt lever.

In addition, a side cross section of the parallel lever may have an isosceles triangle shape, and the parallel link, the bucket cylinder, and the first connecting shaft may be rotatably connected in the vicinity of vertices of the isosceles triangle shape, respectively.

In addition, the lift cylinder and the bucket cylinder may be installed so as to be directed forward, respectively, in a direction in which a cylinder rod is directed toward the bucket, and working hydraulic pressure may be supplied to a cylinder head side.

According to the present disclosure as described above, the parallel lever and the parallel link operate to prevent the working tool from bending inward so that, even if the working tool is raised, a tilting phenomenon in which the working tool is inclined inward may be prevented, and an amount of change in posture of the working tool at each height may be reduced.

In addition, when working hydraulic pressure is supplied to the head side of each of the cylinders, a larger amount of hydraulic fluid may be supplied at one time in comparison with a case in which working hydraulic pressure is supplied to the cylinder rod side, such that excavating ability or power may be increased at a posture on the ground surface.

In addition, like the related art, the parallel linkage-type working apparatus for construction equipment has two cylinders for operating a parallel linkage, also has a similar operating relationship to that of the related art, and has a main angle specification for operating the linkage which is similar to a typical work environment, so as to enable even a worker who is a beginner to quickly become accustomed to using the apparatus without any separate training or perceiving a sense of difference.

DESCRIPTION OF MAIN REFERENCE NUMERALS OF DRAWINGS

Figure 1:
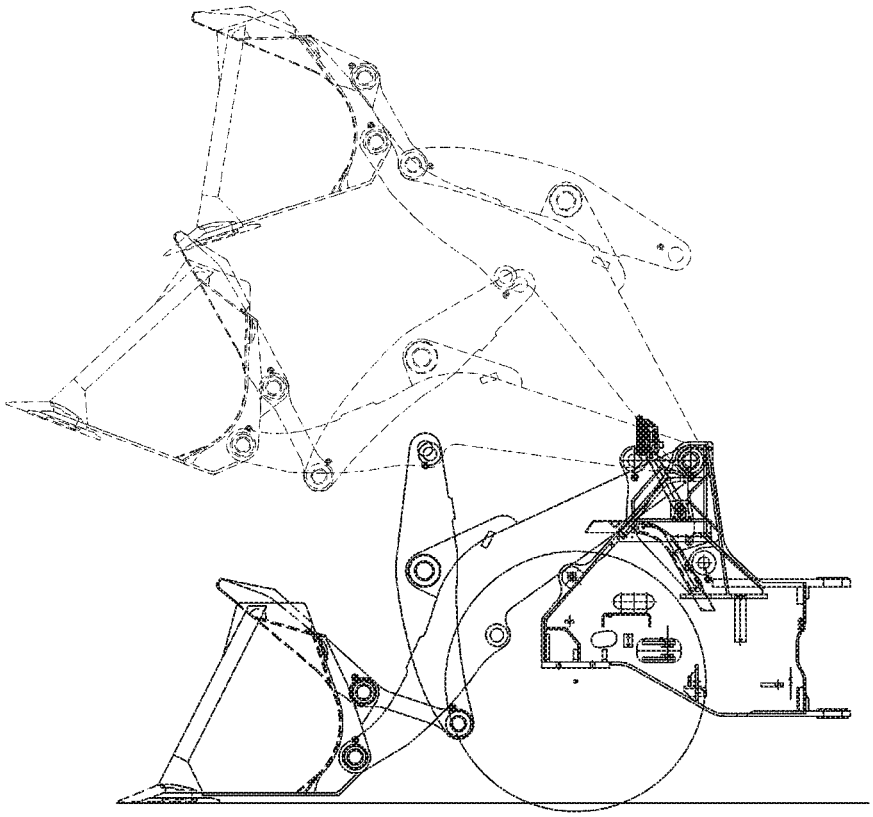
FIG. 1 (Prior Art)
FIG. 1 is an example illustrating construction equipment in the related art which operates a working tool by a linkage.
Figure 2:
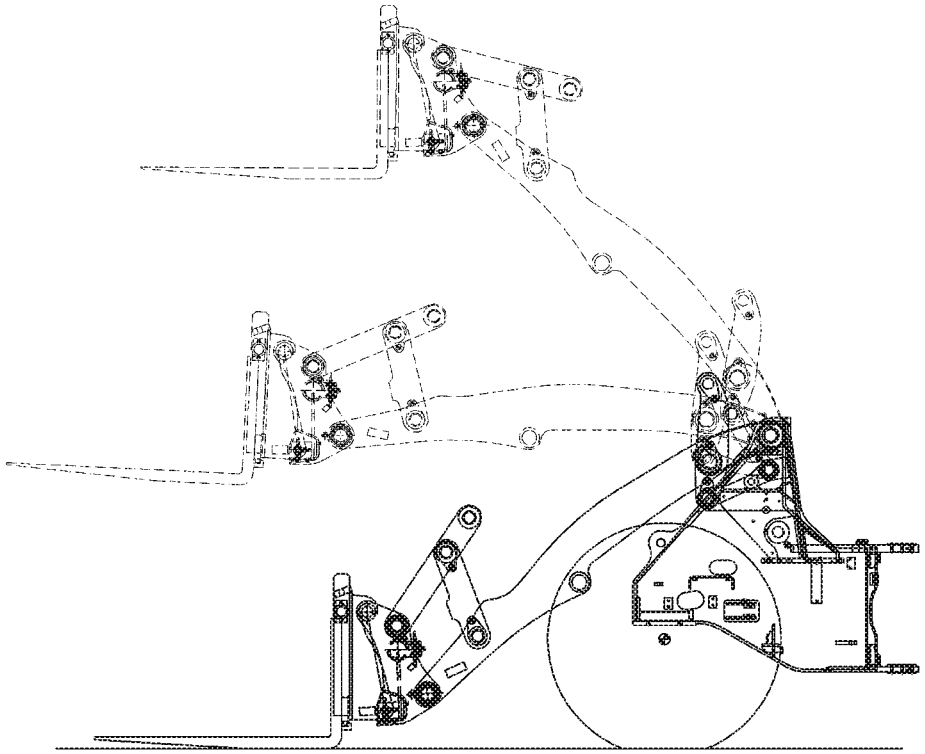
FIG. 2 (Prior Art)
FIG. 2 is another example illustrating the construction equipment in the related art which operates the working tool by the linkage.

110: Base frame
111: Side bracket
112: Center bracket
120: Lift arm
130: Lift cylinder
140: Parallel link
150: Parallel lever
160: Bucket cylinder
170: Tilt lever
171: Push link
181: Fixed shaft
182: First connecting shaft
183: Second connecting shaft
192: First hinge axis
194: Second hinge axis
B: Bucket

DETAILED DESCRIPTION

Hereinafter, a parallel linkage-type working apparatus for construction equipment according to an exemplary embodiment of the present disclosure will be described in detail with reference to the accompanying drawings.

However, hereinafter, a bucket will be described as an example of a working tool that is operated by a parallel linkage, and a wheel loader will be described as an example of various types of construction equipment.

However, the present disclosure is not limited thereto, and it is obvious that various tools such as a fork may be used as the working tool, and various types of equipment such as shovel series heavy equipment may also be applied as the construction equipment.

Figure 3:
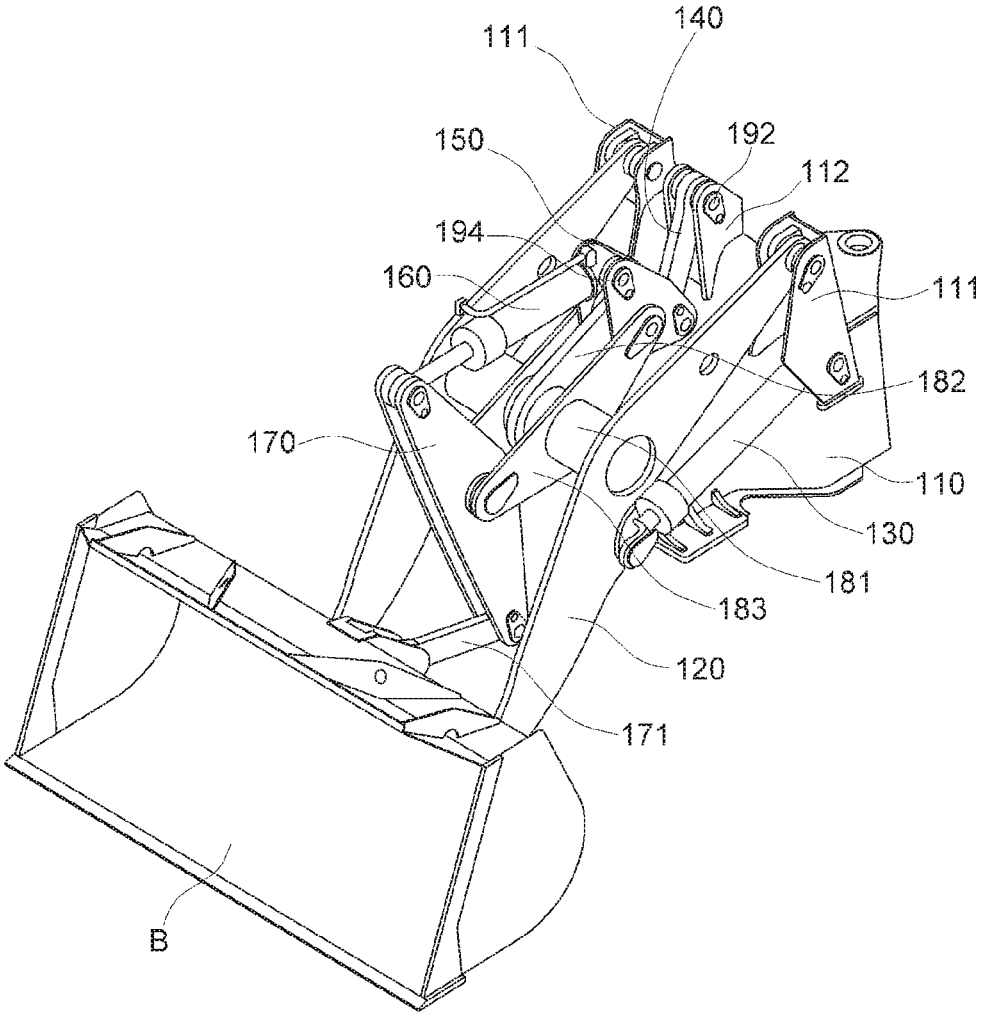
FIG. 3 is a perspective view illustrating a parallel linkage-type working apparatus for construction equipment according to the present disclosure.
Figure 4:
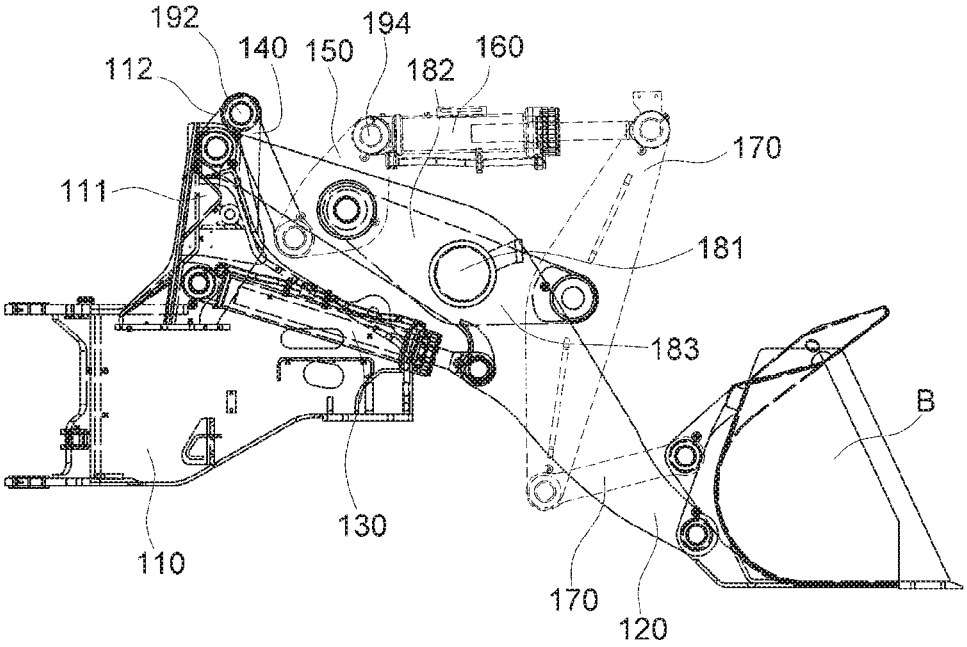
FIG. 4 is a side perspective view illustrating the parallel linkage-type working apparatus for construction equipment according to the present disclosure.

As illustrated in FIGS. 3 and 4, a parallel linkage-type working apparatus for construction equipment according to the present disclosure includes a base frame 110, side brackets 111, lift arms 120, and lift cylinders 130 that are configured to raise or lower a bucket B that is a working tool.

In addition, the parallel linkage-type working apparatus includes a center bracket 112, a parallel link 140, a parallel lever 150, a bucket cylinder 160, a tilt lever 170, and connecting shaft parts 181, 182, and 183 that are configured for maintaining a posture of the bucket B that is being raised or lowered. The connecting shaft parts 181, 182, and 183 include a fixed shaft 181, a first connecting shaft 182, and a second connecting shaft 183.

In this case, the base frame 110 is a part that is connected to a front side of the wheel loader in which a traveling apparatus and a driver seat are provided, and typically provided with a steering bracket at a rear end so that the base frame 110 may be rotatably connected to the front side of the wheel loader.

Therefore, the aforementioned configuration allows the working apparatus to be rotated in a left and right direction at a designed angle at the front side of the wheel loader, and supports the working apparatus.

The side brackets 111 are provided at both upper sides of the base frame 110, respectively, and for example, the side bracket 111 has a shape in which an approximate '⊏' shaped bracket is elongated in an upward and downward direction, and an opening portion thereof is fixed so as to be directed forward.

In addition, rotation brackets are fixedly inserted at upper and lower portions of a portion where the lift arm 120 and the lift cylinder 130 are connected, respectively, and the lift arm 120 and the lift cylinder 130 are rotatably connected to the upper and lower portions of the side bracket 111, respectively.

The lift arms 120 serve to raise or lower the bucket B by receiving power from the lift cylinder 130, and are connected to the side brackets 111, respectively, which are fixed to both sides of the base frame 110, respectively, one end of the lift arm 120 is rotatably connected to the upper portion of the side bracket 111, and the other end of the lift arm 120 is rotatably connected to the bucket B.

For example, the lift arm 120 is formed in an 'S' shape that is curved overall, and has a long length.

The lift cylinder 130 serves to operate the lift arm 120, a hydraulic cylinder is used as the lift cylinder 130, one end of the lift cylinder 130 is rotatably connected to the lower portion of the side bracket 111, and the other end of the lift cylinder 130 is rotatably connected to a central side in a length direction of the lift arm 120. A pair of lift cylinders 130 operates a pair of lift arms 120, respectively.

Particularly, a cylinder head side of the lift cylinder 130 is connected with the side bracket 111 as the one end, a tip portion of a cylinder rod withdrawn from the cylinder is connected to the lift arm 120 as the other end, and working hydraulic pressure, which withdraws the cylinder rod, is supplied to the cylinder head side.

Figure 5:
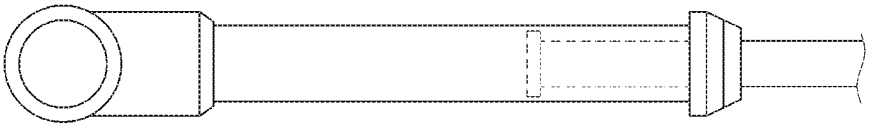
FIG. 5 is a perspective view illustrating a cylinder of the parallel linkage-type working apparatus for construction equipment according to the present disclosure.

As illustrated in FIG. 5, a space in the cylinder is smaller as much as a volume of the cylinder rod at the cylinder rod side than at the cylinder head side. Therefore, in a case in which working hydraulic pressure is supplied to the cylinder head side, a larger amount of hydraulic fluid may be supplied at one time such that a stronger force is provided in comparison with a case in which working hydraulic pressure is supplied to the cylinder rod side.

In addition, the lift cylinder 130 is connected to a curved portion formed at the central side of the 'S' shaped lift arm 120, such that the lift arm 120 may be pushed by a stronger force when the cylinder rod of the lift cylinder 130 is withdrawn.

The center bracket 112 is provided at an upper central side of the base frame 110, and disposed between the side brackets 111, and a hinge bracket is fixed in the center bracket 112, such that the parallel link 140 is rotatably supported by inserting the parallel link 140 into the hinge bracket, and thereafter assembling a rotation pin thereto.

One end of the parallel link 140 is rotatably connected to the center bracket 112, and the other end of the parallel link 140 is rotatably connected to a lower portion of the parallel lever 150.

The parallel lever 150 serves to operate the bucket cylinder 160 and the bucket B in conjunction with each other, and on the basis of the drawings, the other end of the parallel link 140 is rotatably connected to a lower portion of the parallel lever 150, the head side of the bucket cylinder 160 is rotatably connected to an upper portion of the parallel lever 150, and a first connecting shaft 182 of the connecting shaft portions 181, 182, and 183 is rotatably connected to a central axis of the parallel lever 150.

Particularly, a side cross section of the parallel lever 150 has an approximate isosceles triangle shape, and in this case, the parallel link 140, the bucket cylinder 160, and the first connecting shaft 182 of the connecting shaft portions 181, 182, and 183 are rotatably connected in the vicinity of the vertices, respectively, such that the parallel link 140, the bucket cylinder 160, and the first connecting shaft 182 of the connecting shaft portions 181, 182, and 183 are stably operated in conjunction with each other.

The bucket cylinder 160 serves to adjust an angle of the bucket B so as to form an excavating posture or a dumping posture, a hydraulic cylinder is used as the bucket cylinder 160, one end of the bucket cylinder 160 is rotatably connected to the upper portion of the parallel lever 150, and the other end of the bucket cylinder 160 is rotatably connected to an upper portion of the tilt lever 170 as described above.

Like the lift cylinder 130, the cylinder head side of the bucket cylinder 160 is connected to the parallel lever 150 as the one end, the tip portion of the cylinder rod, which is withdrawn from the cylinder, is connected to the tilt lever 170 as the other end, and in this case, working hydraulic pressure is supplied to the cylinder head side such that a stronger force may be provided.

The tilt lever 170 serves as a lever, and transmits power of the bucket cylinder 160 to the bucket B, the upper portion of the tilt lever 170 is rotatably connected to the other end of the bucket cylinder 160, and the lower portion of the tilt lever 170 is rotatably connected to the bucket B through a push link 171. That is, the push link 171 is rotatably connected to the lower portion of the tilt lever 170, and the push link 171 is rotatably connected to the bucket B.

The connecting shaft portions 181, 182, and 183 serve to rotatably support the tilt lever 170, and have one end portions rotatably connected in the vicinity of a center of the parallel lever 150, and the other end portions rotatably connected in the vicinity of a center of the tilt lever 170.

For example, the connecting shaft portions 181, 182, and 183 include a fixed shaft 181, the first connecting shaft 182, and a second connecting shaft 183, both ends of the fixed shaft 181 are fixed to the pair of lift arms 120, respectively, the first connecting shaft 182 is fixed to a central side of the fixed shaft 181, and the second connecting shaft 183 is fixed to the fixed shaft 181 at both end sides of the first connecting shaft 182.

In addition, one end of the first connecting shaft 182 is fixed to the fixed shaft 181, the other end of the first connecting shaft 182 is rotatably connected to the central side of the parallel lever 150, one end of the second connecting shaft 183 is fixed to the fixed shaft 181, and the other end of the second connecting shaft 183 is rotatably connected to the central side of the tilt lever 170.

Figure 6:
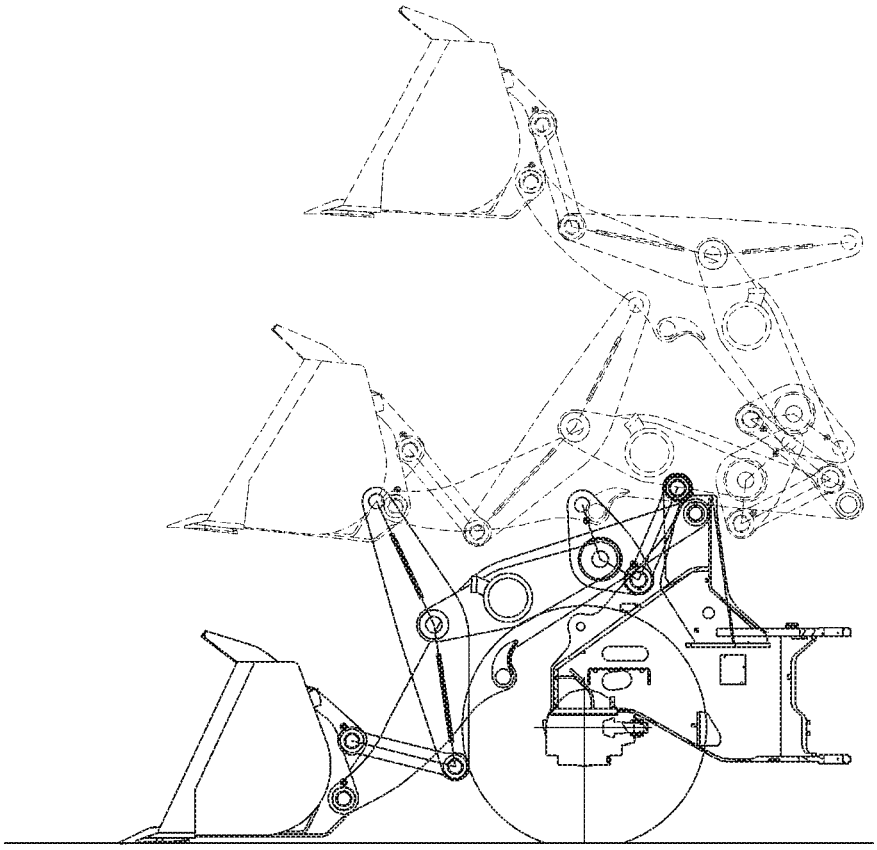
FIG. 6 is a continuous view illustrating an operational state of the parallel linkage-type working apparatus for construction equipment according to the present disclosure.

According to the aforementioned configuration, when a worker operates the lift cylinder 130 so as to insert or withdraw the cylinder rod as illustrated in FIG. 6, the lift arm 120 is rotated in a state in which the lift arm 120 is supported on the side bracket 111 so as to raise or lower the bucket B.

In addition, when the lift arm 120 is raised or lowered, the parallel link 140, the parallel lever 150, the bucket cylinder 160, and the tilt lever 170 in addition to the connecting shaft portions 181, 182, and 183 connected to the lift arm 120 are raised or lowered together with the lift arm 120.

In addition, when the worker operates the bucket cylinder 160 so as to insert the cylinder rod in this state, the bucket B is inclined forward while the upper portion of the tilt lever 170 is pulled, and on the contrary, when the cylinder rod is withdrawn, the bucket B is inclined inward while the upper portion of the tilt lever 170 is rotated forward, such that various types of work such as excavating and dumping may be performed.

Particularly, according to the present disclosure, the parallel link 140 and the parallel lever 150 are automatically folded in accordance with an ascending angle when the bucket B is raised by the lift arm 120, and as a result, a tilting (or 'crowd') phenomenon in which the bucket B is inclined inward when the bucket B is raised is prevented, such that horizontality of the bucket B is always maintained with respect to a working surface. That is, according to the present disclosure, an amount of change in posture at each height of the bucket B is very small.

Therefore, when the worker adjusts an ascending height while seeing the bucket B, the worker may determine the ascending height based on the same reference, and as a result, it is possible to precisely control the height.

In addition, the posture is prevented from being continuously changed regardless of a manipulation of the worker when the bucket B is raised, and as a result, the bucket B is easily inclined with a uniform posture as much as required when the angle of the bucket B is adjusted to perform dumping.

In addition, the respective central portions of the tilt lever 170 and the parallel lever 150 are independently rotatably connected to the connecting shaft portions 181, 182, and 183, such that the postures of the tilt lever 170 and the parallel lever 150 may be more precisely adjusted when the bucket cylinder 160 is operated, thereby further improving the aforementioned effect.

In addition, when working hydraulic pressure is supplied to the head side of each of the cylinders, a larger amount of hydraulic fluid may be supplied at one time in comparison with a case in which working hydraulic pressure is supplied to the cylinder rod side, such that excavating ability may be further increased at a posture on the ground surface.

In addition, the bucket B is raised by the lift cylinder 130, the angle of the bucket B is changed by the bucket cylinder 160, and an operational specification is similar to a typical work environment of a wheel loader, which has been used from the past, such that it is possible to enable even a worker who is a beginner to quickly become accustomed to using the apparatus without any separate training or perceiving a sense of difference.

Specific exemplary embodiments of the present disclosure have been described above. However, it will be understood by a person with ordinary skill in the technical field to which the present disclosure pertains that the spirit and scope of the present disclosure are not limited to the specific exemplary embodiments, and various corrections and modifications may be made without departing from the subject matter of the present disclosure.

Therefore, the exemplary embodiments disclosed above are set forth to provide a complete understanding of the scope of the disclosure to a person with ordinary skill in the technical field to which the present disclosure pertains, such that it should be understood that the exemplary embodiments are described for illustration in all aspects and are not restrictive, and the present disclosure will only be defined by the scope of the claims.

The present disclosure may be used in the parallel linkage-type working apparatus for construction equipment that may prevent a tilting phenomenon in which the working tool is inclined inward, and may reduce an amount of change in posture at each height of the working tool.

The invention claimed is:

1. A parallel linkage-type working apparatus for use with construction equipment, comprising:

a base frame which is configured to connect to a front side of a traveling apparatus;

a lift arm which has one end configured to rotatably connect to the base frame, and the other end configured to rotatably connect to a bucket;

a lift cylinder which has one end configured to rotatably connect to the base frame, and the other end configured to rotatably connect to a central side in a length direction of the lift arm;

a parallel link which has one end configured to rotatably connect to the base frame;

a parallel lever which has a lower portion configured to rotatably connect to the other end of the parallel link;

a bucket cylinder which has one end configured to rotatably connect to an upper portion of the parallel lever;

a tilt lever which has an upper portion configured to rotatably connect to the other end of the bucket cylinder, and a lower portion configured to rotatably connect to the bucket through a push link configured to rotatably connect to the bucket; and connecting shaft portions which have end portions configured to rotatably connect to a central side of the parallel lever, and the other end portions are configured to rotatably connect to a central side of the tilt lever;

wherein the parallel link and the parallel lever are configured to rotate relatively to each other in a direction in which a first hinge axis between the parallel link and the base frame and a second hinge axis between the parallel lever and the bucket cylinder move toward each other when the lift arm is raised without operating the bucket cylinder.

2. The parallel linkage-type working apparatus of claim 1, wherein the connecting shaft portions include:

a fixed shaft which has both ends that are fixed to a pair of lift arms, respectively;

a first connecting shaft which has one end fixed to the fixed shaft, and the other end configured to rotatably connect to the central side of the parallel lever; and a second connecting shaft which has one end fixed to the fixed shaft, and the other end configured to rotatably connect to the central side of the tilt lever.

3. The parallel linkage-type working apparatus of claim 2, wherein a side cross section of the parallel lever has an isosceles triangle shape, and the parallel link, the bucket cylinder, and the first connecting shaft are configured to rotatably connect in the vicinity of vertices of the isosceles triangle shape, respectively.

* * * * *